US006211832B1

(12) United States Patent
Endo et al.

(10) Patent No.: US 6,211,832 B1
(45) Date of Patent: Apr. 3, 2001

(54) WINDOWPANE ANTENNA APPARATUS FOR VEHICLES

(75) Inventors: Hiroshi Endo, Tokyo; Akira Wakui; Michihiko Hashimoto, both of Yokohama; Masatoshi Saitoh, Machida, all of (JP); Mahmood Ahrabian, Novi, MI (US)

(73) Assignee: Harada Industry Co., Ltd. (JP)

( * ) Notice: Subject to any disclaimer, the term of this patent is extended or adjusted under 35 U.S.C. 154(b) by 0 days.

(21) Appl. No.: 09/405,238

(22) Filed: Sep. 24, 1999

(30) Foreign Application Priority Data

Oct. 5, 1998 (JP) ..... 10-282870

(51) Int. Cl.[7] ..... H01Q 1/32
(52) U.S. Cl. ..... 343/713; 343/704
(58) Field of Search ..... 343/713, 711, 343/704, 712, 729, 850, 860, 876

(56) References Cited

U.S. PATENT DOCUMENTS 4,063,247 * 12/1977 Sakurai et al. ..... 343/704
5,097,270 3/1992 Flachenecker et al. ..... 343/704
5,113,195 * 5/1992 Sakurai et al. ..... 343/704
5,610,618 3/1997 Adrian et al. ..... 343/713
5,654,720 * 8/1997 Saitou et al. ..... 343/713
5,877,727 * 3/1999 Saito et al. ..... 343/713
5,933,119 * 8/1999 Fujii et al. ..... 343/713
6,043,783 * 3/2000 Endo et al. ..... 343/713

* cited by examiner

*Primary Examiner*—Don Wong
*Assistant Examiner*—Chuc Tran D
(74) *Attorney, Agent, or Firm*—Pennie & Edmonds LLP

(57) ABSTRACT

A windowpane antenna apparatus for vehicles according to the present invention includes a defogger mounted on a window of a vehicle, for defogging the window, means for causing the defogger to serve as a slot antenna, and a driven antenna arranged close and opposite to the defogger with a given gap therebetween in such a manner that one side of the driven antenna is mutually coupled to one side of the defogger.

4 Claims, 5 Drawing Sheets

WINDOWPANE ANTENNA APPARATUS FOR VEHICLES

BACKGROUND OF THE INVENTION

The present invention relates to a windowpane antenna apparatus for vehicles which is mounted on a windowpane of a vehicle such as an automobile.

There is a windowpane antenna apparatus for automobiles as the most typical one of conventional windowpane antenna apparatuses for vehicles. The typical antenna apparatus includes a thin, narrow, strip conductor provided on a window (usually a rear window) of an automobile, and the strip conductor is employed as an antenna.

In recent automobiles, a defogger is provided almost all over the rear window to serve as a heater for defogging the window. The antenna therefore has to be mounted in a limited space between the defogger and the window frame.

FIG. 8 shows an example of a prior art automobile windowpane antenna apparatus. As shown, a defogger 110 is mounted on a rear window 100, and a loop-shaped antenna 120 constituted of a strip conductor is formed in a region above the defogger 110.

A DC power supply voltage is applied to the defogger 110 from a car-mounted battery 111 through a noise filter 112 (which is constituted of, e.g., a choke coil and a capacitor) for eliminating high-frequency noise (in the AM band) and a power supply voltage application line 113.

A reception signal of the antenna 120 is transmitted to a receiver set such as a radio from a feeding point 121 through a feeding cable (not shown).

FIGS. 9 to 11 are illustrations for explaining the performance of the prior art automobile windowpane antenna apparatus described above. These illustrations are used to describe an automobile windowpane antenna apparatus according to an embodiment of the present invention in comparison with the prior art apparatus.

The prior art antenna apparatus has the problem that its reception sensitivity in the AM and FM bands is not obtained sufficiently since a space for mounting the antenna 120 is limited. The apparatus also has the problem that since frequency characteristics are not flattened within a receiving band, tuning for optimizing the reception performance is difficult and a long period of time is required for performing the tuning operation.

BRIEF SUMMARY OF THE INVENTION

The object of the present invention is to provide a windowpane antenna apparatus for vehicles whose reception sensitivity is high in a wide bandwidth and whose tuning operation is easy to perform.

To attain the above object, a vehicle windowpane antenna apparatus according to the present invention has the following features in constitution. The other features will be clarified later in the Description of the Invention.

A windowpane antenna apparatus for vehicles comprises a defogger mounted on a window of a vehicle, for defogging the window, means for causing the defogger to serve as a slot antenna, and a driven antenna arranged close and opposite to the defogger with a given gap therebetween in such a manner that one side of the driven antenna is mutually coupled to one side of the defogger.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (Embodiment)

Figure 1:
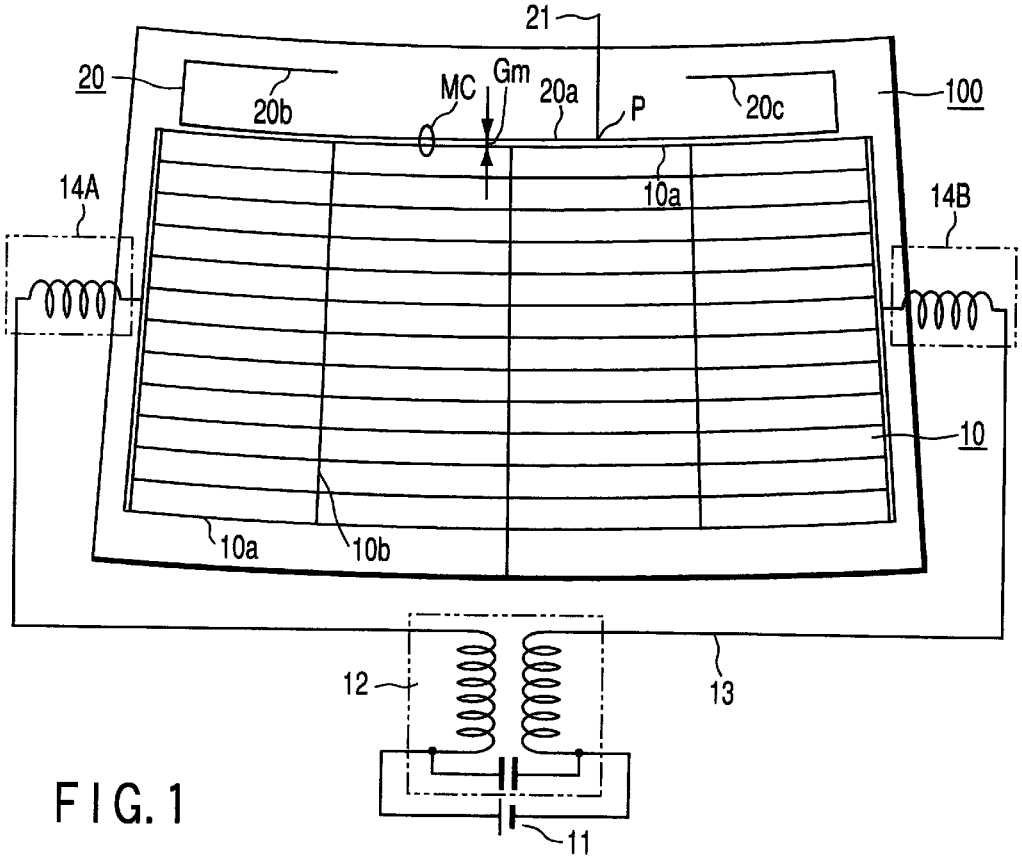
FIG. 1 is a view showing the constitution of a windowpane antenna apparatus for vehicles according to an embodiment of the present invention.

FIG. 1 illustrates the constitution of a windowpane antenna apparatus for vehicles (automobiles) according to an embodiment of the present invention. As shown in FIG. 1, a defogger 10 is formed almost all over a rear window 100 of a vehicle (e.g., an automobile) to serve as a heater for defogging the window.

The defogger 10 includes a plurality of horizontal lines 10*a* arranged in parallel with each other and several (three in this embodiment) vertical lines 10*b* which cross the horizontal lines. The horizontal and vertical lines 10*a* and 10*b* are each constituted of a very thin, narrow, strip conductor.

The defogger 10 therefore has a mesh pattern including a number of meshes (openings) as shown in FIG. 1. The mesh pattern is so formed that the length of a longer side of each mesh is set considerably small for the wavelength (1 [m] or more) of a VHF band or it is set not more than 1/10 to 1/20 of the wavelength. The defogger 10 can thus be considered to be equivalently a single metal thin plate for a received wave.

A DC power supply voltage is applied to the defogger 10 as a heat source from a car-mounted battery 11 through a noise filter 12 (which is constituted of, e.g., a choke coil and a capacitor) for eliminating high-frequency noise (in the AM band), a DC power supply voltage application line 13, and a pair of FM choke coils 14A and 14B.

The FM choke coils 14A and 14B separate the DC power supply voltage application line 13 from both ends of the defogger 10 to render the ends in a high-frequency state and thus serve as inductance elements.

A non-loop driven antenna 20, which is obtained by cutting part (upper central part) of a rectangular loop, is provided in a region above the defogger 10 or a region of the window between the uppermost portion of the defogger and the upper frame of the window. Like the defogger 10, the driven antenna 20 is constituted of a very thin, narrow, strip conductor. The driven antenna 20 is formed close and opposite to the defogger 10 with a given gap Gm (about 1 [cm] to 2 [cm]) therebetween in such a manner that one side of the antenna 20 or a bottom 20*a* thereof is mutually coupled to one side of the defogger 10 or the uppermost one of the horizontal lines 10*a* (coupling index K is approximately 1). A feeding section 21 is set in position P, which is slightly shifted to the right (in FIG. 1) from the middle of the bottom 20*a* of the driven antenna 20, and connected to a receiver set (not shown) through a feeding cable (not shown).

In FIG. 1, reference symbol MC indicates a mutual coupling portion between the defogger 10 and driven antenna 20, and reference numerals 20*b* and 20*c* denote open ends of the driven antenna 20.

Figure 2:
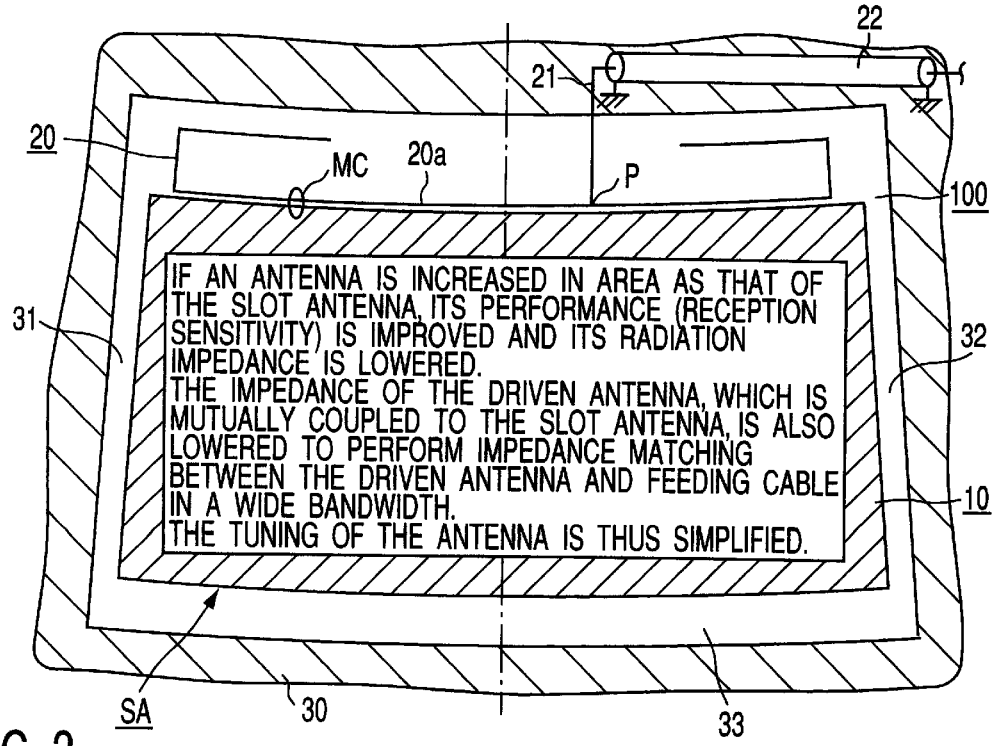
FIG. 2 is an illustration for explaining the principle of the windowpane antenna apparatus according to the embodiment of the present invention.

FIG. 2 is an illustration for explaining the principle of the antenna apparatus shown in FIG. 1. As described above, the defogger 10 is formed in a mesh pattern and considered to be equivalently a single thin metal plate for a received wave. Both ends of the defogger 10 are rendered in a high-frequency state by the paired FM choke coils 14A and 14B each serving as an inductance element. Therefore, the entire rear window 100 serves as an opening area 31, 32, 33 of a slot antenna surrounded with a metal body 30 of a car body which is considered to be an ideal ground (ground plane) and accordingly the defogger 10 functions as a slot antenna SA in the AM/FM band.

The coupling capacitance CX of a mutual coupling section MC of the defogger 10 and driven antenna 20 arranged close to each other, is set equal to or larger than 20 PF (CX≧20 PF). The driven antenna 20 is thus coupled to the slot antenna SA of the defogger 10 by relatively great force and their interaction decreases a radiation impedance of the driven antenna 20 or an output impedance. Consequently, the frequency characteristics are flattened within a receiving band and the band is broadened. Since the feeding section 21 of the driven antenna 20 is located in the position P slightly shifted from the middle of the antenna 20, impedance matching between the feeding section 21 and a feeding cable 22 is easily performed.

(Modification to the Embodiment)

Figure 3:
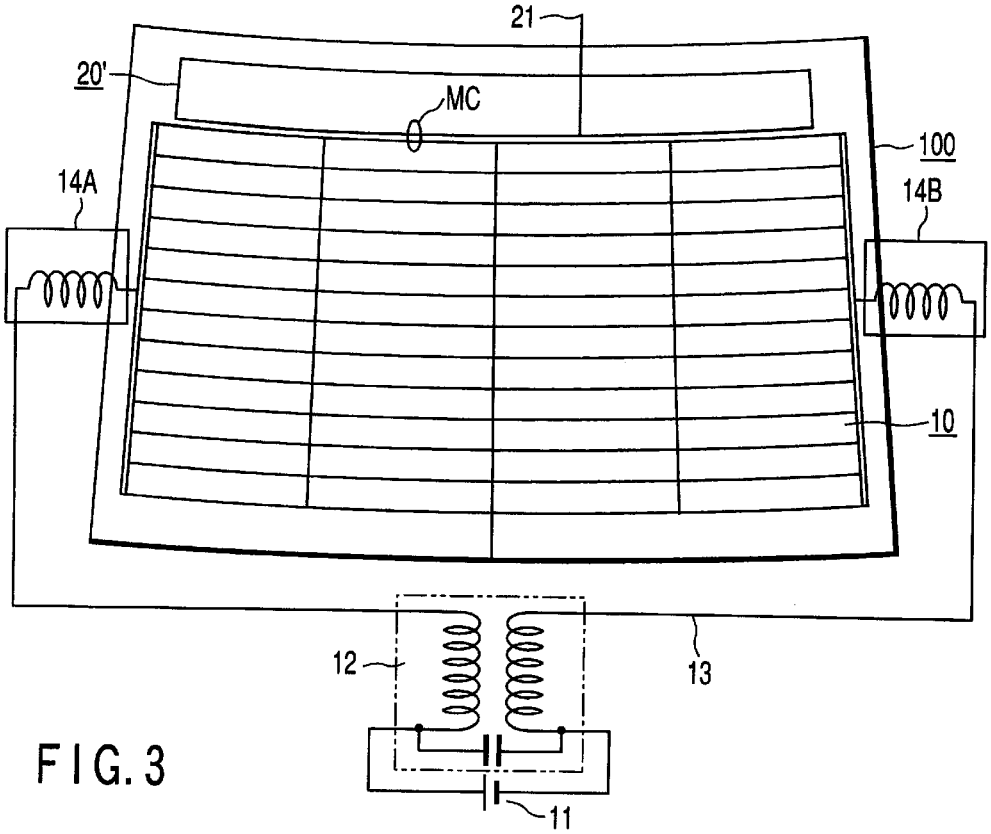
FIG. 3 is a view showing a modification to the windowpane antenna apparatus according to the embodiment of the present invention in which a driven antenna is shaped like a loop.
Figure 4:
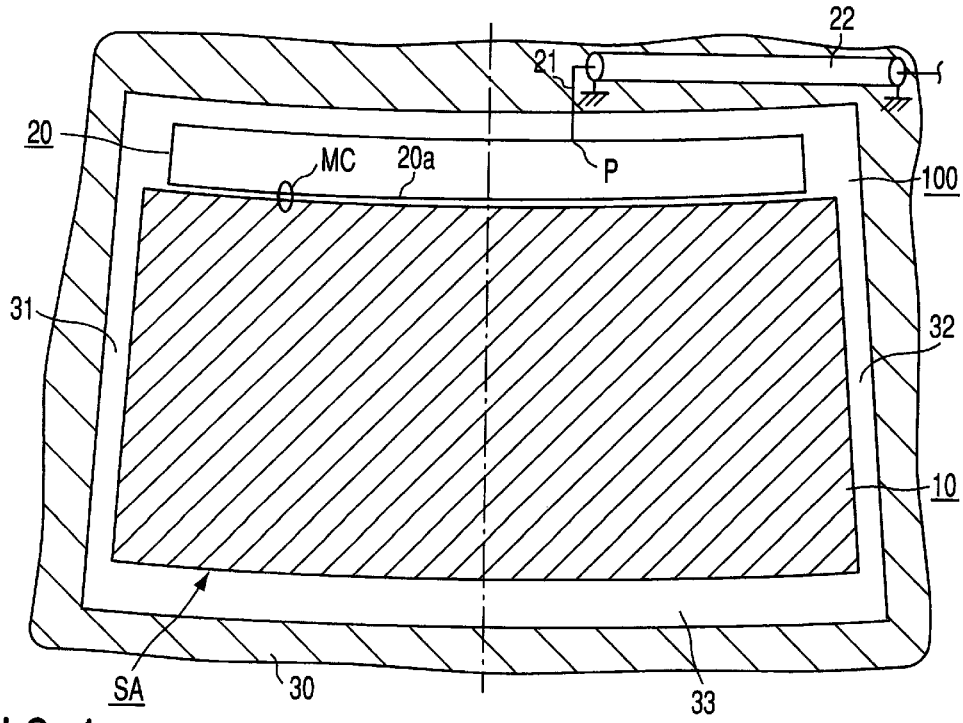
FIG. 4 is an illustration for explaining the principle of the modification shown in FIG. 3.

FIG. 3 is a view of a modification to the windowpane antenna apparatus according to the embodiment described above, and FIG. 4 is a view showing the principle of the modification. The modification differs from the embodiment in that a loop-shaped driven antenna 20' is used in place of the antenna 20. The other constituting elements are the same as those of the above embodiment and thus their descriptions are omitted.

Various shapes as well as the above ones can be applied to the driven antenna.

(Operation of the Embodiment)

Figure 5:
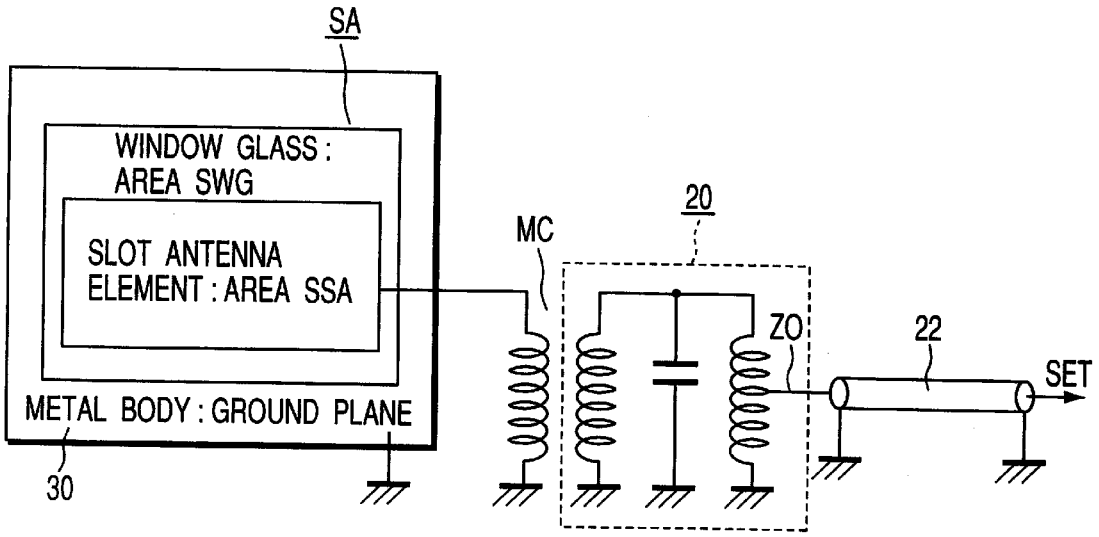
FIG. 5 is an equivalent circuit diagram of the windowpane antenna apparatus according to the embodiment of the present invention to describe its performance and function in an FM band.
Figure 6:
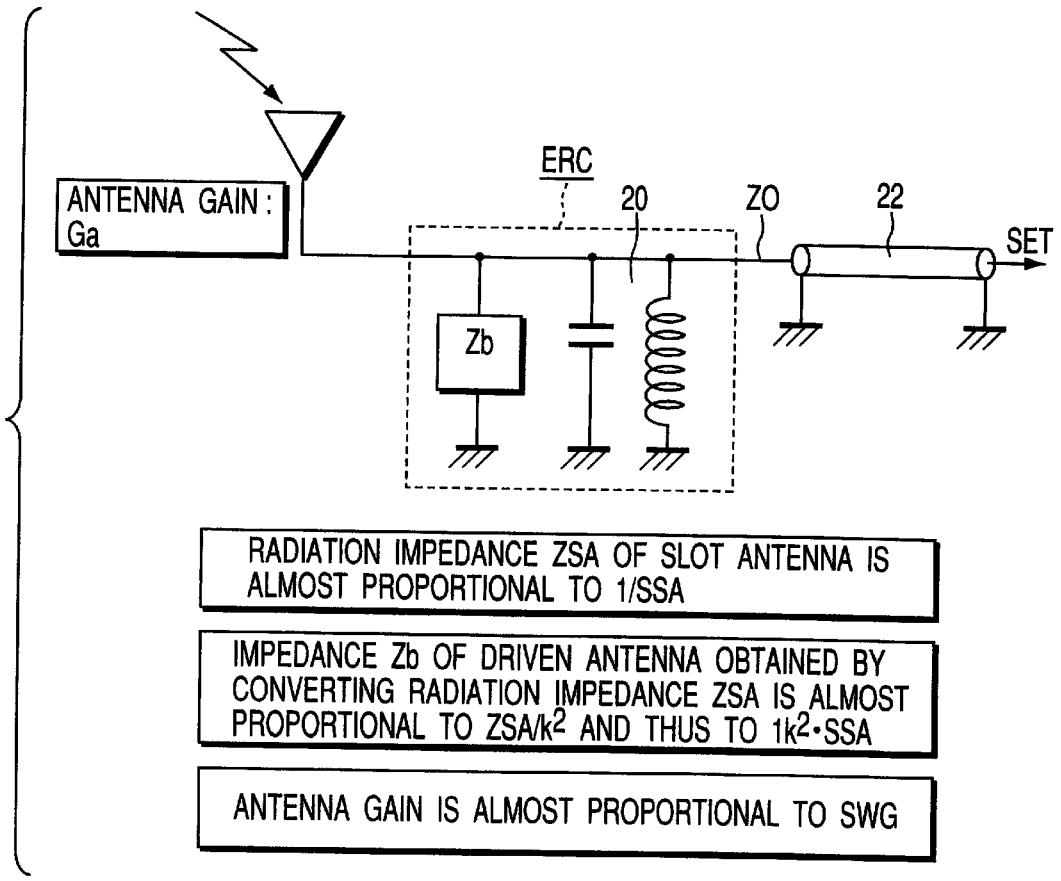
FIG. 6 is a simplified equivalent circuit diagram of the windowpane antenna apparatus according to the embodiment of the present invention.
Figure 9:
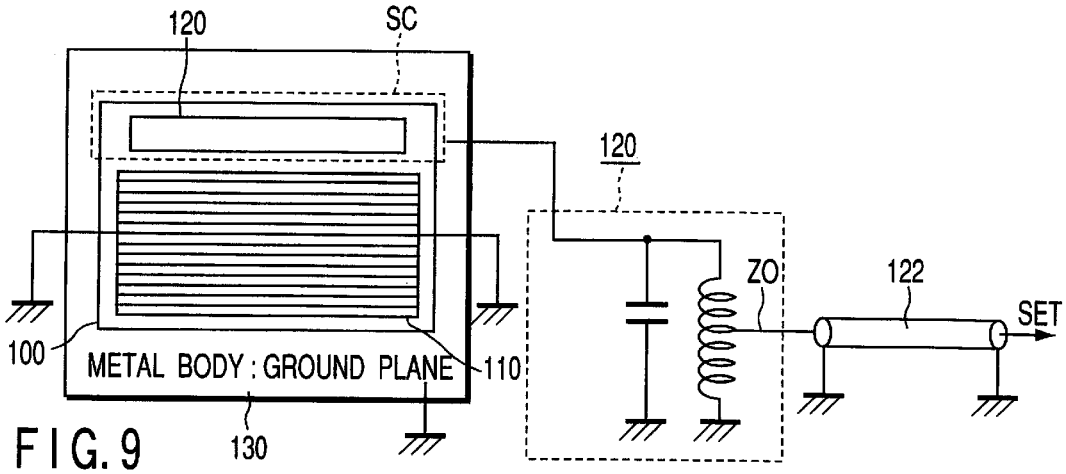
FIG. 9 PRIOR ART
FIG. 9 is an equivalent circuit diagram of the prior art windowpane antenna apparatus to describe its performance and function in an FM band.
Figure 10:
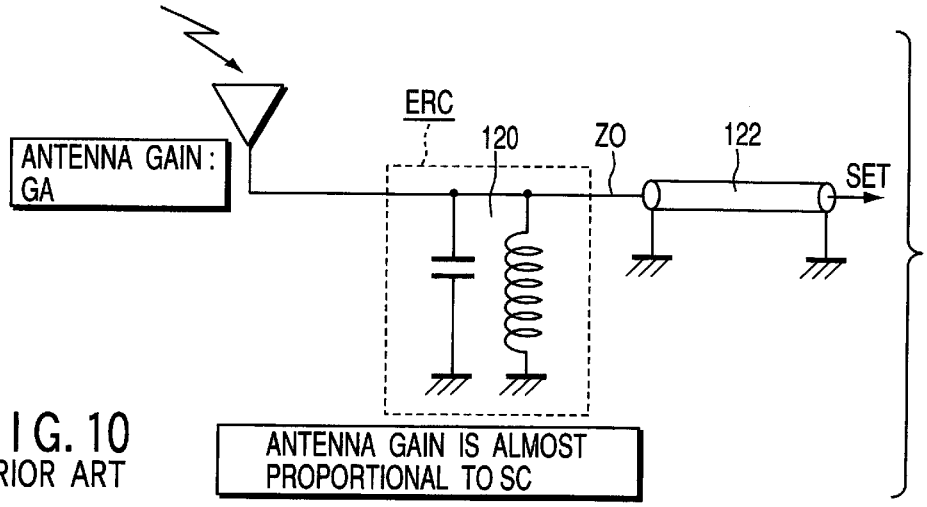
FIG. 10 PRIOR ART
FIG. 10 is a simplified equivalent circuit diagram of the prior art windowpane antenna apparatus.

Performance and Function in FM Band:

FIG. 5 is an equivalent circuit diagram of the windowpane antenna apparatus according to the above embodiment to describe its performance and function in an FM band, and FIG. 6 is a simplified equivalent circuit diagram of the windowpane antenna apparatus shown in FIG. 5. Referring to FIGS. 5 and 6 and comparing them with FIGS. 9 and 10 showing a prior art antenna apparatus, the performance of the antenna apparatus of the present invention will be described. In FIG. 5, SA indicates a slot antenna and Zo represents an output impedance.

1) Gain of Antenna

As illustrated in FIGS. 5 and 6, impedance matching between the slot antenna SA, which is formed chiefly of the defogger 10, and the driven antenna 20 arranged close thereto is performed satisfactorily by means of the mutual coupling section MC. Therefore, most power received by the slot antenna SA is supplied to the receiver set (not shown) such as a radio through a feeding cable 22. It is thus thought that the antenna gain Ga of the present antenna apparatus is almost proportional to the area SWG of the whole window glass.

In the prior art antenna apparatus as shown in FIGS. 9 and 10, region of the defogger 110 is short-circuited with a ground plane 130 in a high-frequency region of the FM band, so that the effective area of the antenna 120 is limited to a small region existing above the defogger 110. It is thus thought that the antenna gain GA is almost proportional to the area SC of the above region.

The ratio of SWG to SC is 4:1 to 5:1. It will be understood from this ratio that the antenna gain Ga of the antenna apparatus of the present invention is considerably higher than that GA of the prior art antenna apparatus.

2) Impedance of Antenna

In FIG. 6, Zb shows an impedance of the driven antenna obtained by converting a radiation impedance ZSA of the slot antenna SA, which is almost proportional to the inverse 1/SSA of the area SSA of a region where the defogger 10 is formed, using a coupling coefficient k of the mutual coupling section MC. As illustrated in FIG. 6, an equivalent resonant circuit ERC of the antenna apparatus of the present invention includes an impedance component of the driven antenna 20 and the above impedance Zb which is connected in parallel to the component.

In the prior art antenna apparatus shown in FIG. 10, an equivalent resonant circuit ERC does not include any equivalent for the above impedance Zb.

Since, in the present invention, the impedance Zb is contained in the equivalent resonant circuit ERC, the output impedance Zo of the antenna apparatus is lowered and so is a Q (sharpness of resonance) value thereof. Consequently, a reception frequency characteristic within a desired frequency band becomes constant and the frequency band is broadened.

Since, moreover, the impedance zb is almost inversely proportional to the product of the area SSA and the square ($k^2$) of coupling coefficient k of the mutual coupling section MC, the frequency characteristic can properly be determined if the coefficient k is set to an adequate value.

The coupling index K, which is equal to k×[square root of (Q of slot antenna)×(Q of driven antenna including a feeding cable of a load)], is close to 1. Inevitably, the coupling coefficient k becomes considerably smaller than 1.

The Q (=QS) in the slot antenna SA is almost proportionate to the inverse 1/SSA. QS is therefore given as follows:

$$QS \approx X/SSA \quad (1)$$

where X is a coefficient.

If the Q (=QL) in the equivalent resonant circuit ERC is the following equation is given:

$$QL=(QE \cdot QS)^{1/2} \quad (2)$$

Where QE is Q in the driven antenna.

The Q (=QC) in the antenna 120 is almost proportionate to 1/SC. QC is thus expressed by:

$$QC \approx X/SC \quad (3)$$

where X is a coefficient.

If QE is equal to QC considering that the effective area of the driven antenna 20 and that (SC) of the windowpane antenna 120 are approximately equal to each other, the following is derived from the above equation (2):

$$QL \approx (QC \cdot QS)^{1/2} \quad (4)$$

Substituting the expressions (1) and (3) into the expression (4), QL is given as follows:

$$QL \approx [(X/SC) \cdot (X/SSA)]^{1/2} \quad (5)$$

where SSA is approximately equal to N·SC (N=an integral multiple, 4 or 5). (6)

Substituting the expression (6) into the expression (5), the following is given as follows:

$$QL \approx (X/SC)[1/N]^{1/2} \quad (7)$$

Applying the expression (3) into the expression (7), the following is given by:

$$QL \approx QC[1/N]^{1/2} \quad (8)$$

Applying N (=4 to 5) to the expression (8), QL is expressed by:

$$QL \approx QC/2 \quad (9)$$

The Q (=QL) in the antenna apparatus of the present invention is equal to or smaller than half the Q (=QC) in the windowpane antenna 120. It is thus understood that the passing frequency band (having a bandwidth of 3 dB) of the FM band of the antenna apparatus is two or more times greater than that of the prior art antenna apparatus.

As described above, it is evident that the antenna apparatus of the above embodiment is excellent in that its reception sensitivity (which is proportionate to the antenna gain) almost corresponds to the effective area of the antenna. Since, moreover, the output impedance Zo of the antenna can be lowered and the value Q of the antenna can be decreased, the frequency characteristic is made constant and the frequency band is broadened. The tuning operation (adjustment and modification) of the antenna is thus very easy to perform.

Figure 7:
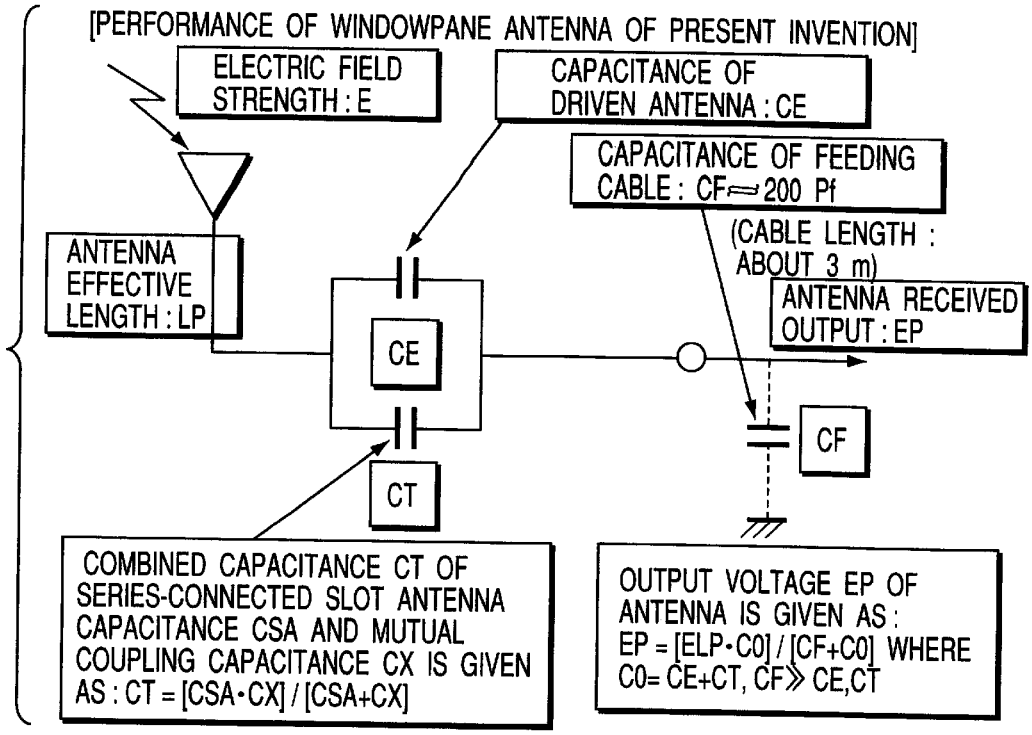
FIG. 7 is an equivalent circuit diagram showing the windowpane antenna apparatus according to the embodiment of the present invention to describe its reception performance in an AM band.
Figure 8:
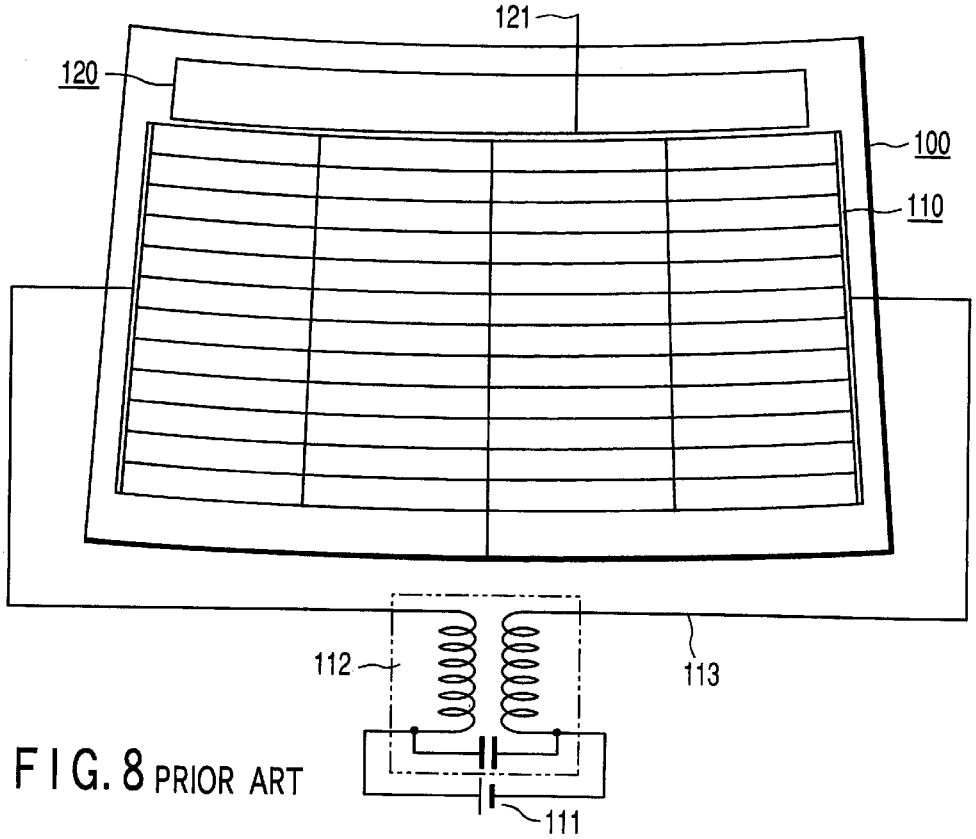
FIG. 8 PRIOR ART
FIG. 8 is a view illustrating the constitution of a prior art windowpane antenna apparatus for vehicles.

Reception Performance (Sensitivity) in AM Band:

FIG. 7 is an equivalent circuit diagram showing the windowpane antenna apparatus according to the above embodiment to describe its reception performance (sensitivity) in the AM band. Referring to FIG. 7 and comparing it with FIG. 11 corresponding thereto and showing a prior art antenna apparatus, the reception performance (sensitivity) of the antenna apparatus of the present invention will now be described. Since, however, the shape of the driven antenna 20 of the present antenna apparatus and that of the antenna 120 of the prior art antenna apparatus are nearly equal to each other, the effective lengths Lp and Lc of the antennas 20 and 120 are substantially equal to each other as basic conditions, as are the antenna capacitances CE and CG thereof.

As illustrated in FIG. 7, the capacitance CE of the driven antenna 20 is connected in parallel with a combined capacitance CT (a combination of antenna capacitance CSA of the slot antenna SA and coupling capacitance CX of the mutual coupling section MC). The antenna-received output voltage EP of the antenna apparatus is therefore increased by a voltage corresponding to the combined capacitance CT.

Figure 11:
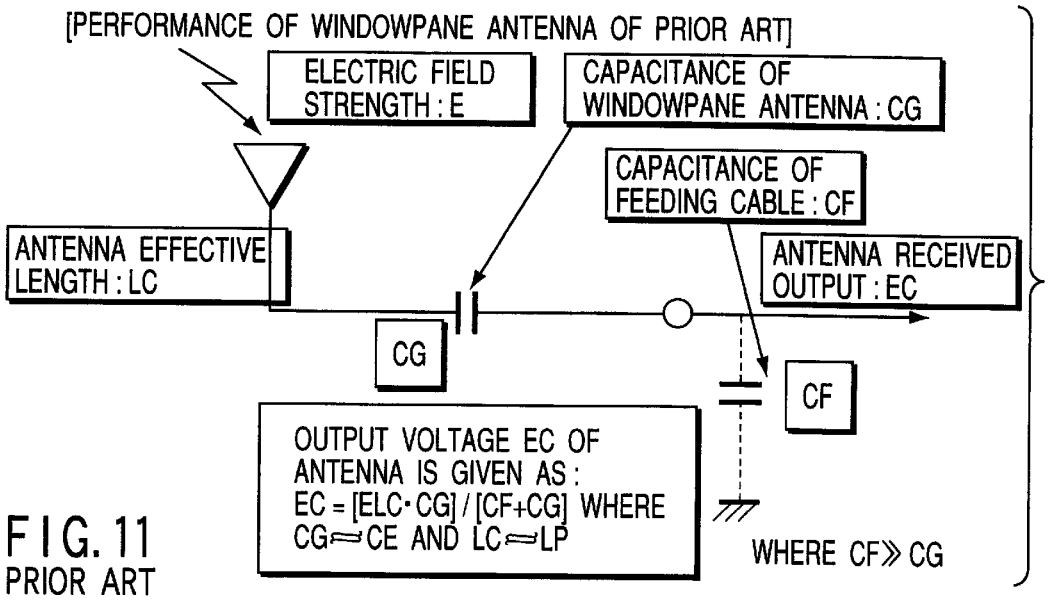
FIG. 11 PRIOR ART
FIG. 11 is an equivalent circuit diagram of the prior art windowpane antenna apparatus to describe its reception performance in an AM band.

In contrast, the prior art antenna apparatus shown in FIG. 11 does not include any equivalent for the above combined capacitance CT but has only the antenna capacitance CG (which is substantially equal to the antenna capacitance CE of the driven antenna 20) of the windowpane antenna 120. The antenna-received output voltage EC of the prior art apparatus is therefore low.

Consequently, the antenna apparatus of the present invention can output a voltage which is higher than that of the prior art antenna apparatus and thus improves in reception performance (sensitivity).

The capacitance CF of the feeding cable 22 is considerably larger than the antenna capacitances CE and CG and the combined capacitance CT. The antenna-received output voltage is thus calculated based on the fact that the capacitance Co or CG of the dominator of an equation for calculating the antenna-received output voltage can be ignored with respect to the capacitance CF. Since, furthermore, the coupling capacitance CX is not lower than 20 pF, it is predicted that the combined capacitance CT becomes 10 pF or higher and equal to or higher than the antenna capacitances CE and CG. For this reason, the antenna-received output voltage EP of the antenna apparatus of the present invention is two or more times higher than that EC of the prior art antenna apparatus, and its reception sensitivity is 6 dB or higher and excellent as compared with that of the prior art apparatus.

The above results have been confirmed together with the performance in the FM band in the trial-development stage and in the experimental stage for evaluation of measured values of the present antenna apparatus.

(Features of the Embodiment)

[1] A windowpane antenna apparatus for vehicles as described in the embodiment comprises a defogger (10) mounted on a window (100) of a vehicle, for defogging the window (100), means for causing the defogger (10) to serve as a slot antenna (SA), and a driven antenna (20) arranged close and opposite to the defogger (10) with a given gap (Gm) therebetween in such a manner that one side **(20*a*) of the driven antenna (20) is mutually coupled to one side (10*a*) of the defogger (10)**.

In the foregoing windowpane antenna apparatus, the defogger (10) serves as a slot antenna (SA) and is mutually coupled to the given antenna (20). Since, therefore, the antenna apparatus is improved in sensitivity in the FM band and the frequency band can be broadened within a receiving band, tuning of the antenna apparatus can be very simplified. In the AM band, too, the reception performance (sensitivity) of the antenna apparatus is considerably higher than that of the prior art antenna apparatus.

[2] In the windowpane antenna apparatus for vehicles as described in the above paragraph [1], the means for causing the defogger (10) to serve as a slot antenna (SA) includes means for separating the defogger (10) from a power supply voltage application line (13) in a high-frequency manner by interposing an inductance element (14A, 14B) between each of both ends of the defogger (10) and the power supply voltage application line (13) and means for causing the defogger (10) to equivalently serve as a single metal thin plate for a received wave by forming the defogger (10) so as to have a mesh pattern including meshes whose long side is equal to or shorter than the wavelength of the received wave.

In the foregoing windowpane antenna apparatus, the defogger (10) can be caused to serve as a slot antenna (SA) more exactly.

[3] The windowpane antenna apparatus for vehicles as described in the embodiment includes a combination of the limitations recited in above paragraphs [1] and [2].

(Modification)

The present invention is not limited to the above-described embodiment. In the embodiment, the present invention is applied to a radio receiving antenna apparatus used in both AM and FM bands. However, it can be applied widely to a TV receiving antenna apparatus in the VHF band and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A windowpane antenna apparatus for vehicles, comprising:

a defogger, mounted on a window of a vehicle, for defogging the window;

means for causing the defogger to serve as a slot antenna; and a driven antenna disposed adjacent to the defogger with a gap therebetween whereby the driven antenna and the defogger are mutually coupled, wherein said means for causing the defogger to serve as a slot antenna includes:

first means for separating the defogger from a power supply voltage application line in a high-frequency manner by interposing an inductance element between each of both ends of the defogger and the power supply voltage application line; and second means for causing the defogger to serve equivalently as a single metal thin plate for a received wave, said second means being obtained by forming the defogger so as to have a mesh pattern including a plurality of meshes, each of said meshes having a long side that is shorter than the wavelength of the received wave.

2. A windowpane antenna apparatus for vehicles according to claim 1, wherein the mesh pattern is formed by intersecting a plurality of horizontal strip conductors arranged in parallel with each other and a plurality of vertical strip conductors at right angles.

3. A windowpane antenna apparatus for vehicles according to claim 1, wherein a length of the long side of each of the meshes is set 1/10 to 1/20 of the received wavelength.

4. A windowpane antenna apparatus for vehicles according to claim 2, wherein a length of the long side of each of the meshes is set 1/10 to 1/20 of the wavelength of the received wave.

* * * * *